United States Patent [19]

Rutherford

[11] 4,012,799

[45] Mar. 22, 1977

[54] APPARATUS AND METHOD FOR TRANSFERRING A PATIENT FROM ONE BED TO ANOTHER

[76] Inventor: Gaery Davis Rutherford, 4522 SW. Holgate, Seattle, Wash. 98116

[22] Filed: June 9, 1975

[21] Appl. No.: 585,104

[52] U.S. Cl. ..... 5/81 R

[51] Int. Cl.[2] ..... E03D 11/10

[58] Field of Search ..... 5/81 R, 81 B, 92, 317 R

[56] References Cited

UNITED STATES PATENTS

| | | | |
|---|---|---|---|
| 2,404,734 | 7/1946 | Lenahan | 5/86 |
| 2,501,267 | 3/1950 | Erikson | 5/352 |
| 2,918,681 | 12/1959 | Davis | 5/81 C |
| 2,959,792 | 11/1960 | Haugard | 5/81 R |
| 3,157,889 | 11/1964 | Chanko | 5/352 |
| 3,403,411 | 10/1968 | Steinemann et al. | 5/81 R |
| 3,786,523 | 1/1974 | Sele | 5/81 B |

*Primary Examiner*—Werner H. Schroeder

*Assistant Examiner*—Doris L. Troutman

*Attorney, Agent, or Firm*—Seed, Berry, Vernon & Baynham

[57] ABSTRACT

A sled board for transferring a patient from one bed to another. In a first embodiment, a plurality of sled boards are placed beneath a patient and the sled boards are simultaneously slid from one bed to another. The patient remains on top of the sled boards, and the sled boards carry the patient from one bed to the other. In a second embodiment, the sled boards, each having a transverse fin projecting from its bottom surface, extend from one bed to the other. The fins are inserted between the beds to prevent longitudinal movement of the sled boards. One end of the sled boards is placed beneath the patient, and the patient is slid from one bed to the other on the top surface of the sled boards.

10 Claims, 5 Drawing Figures

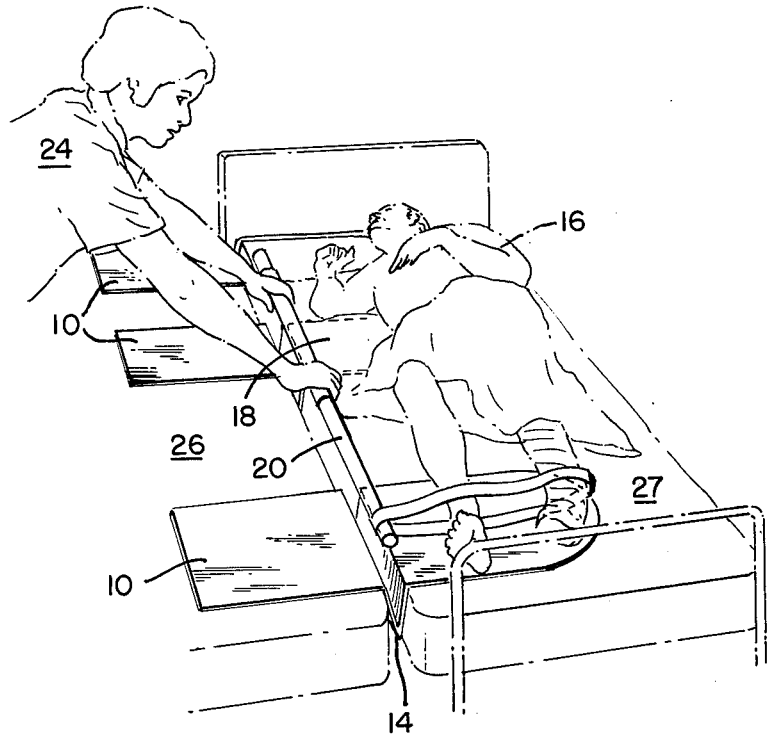
FIG. 1
FIG. 2
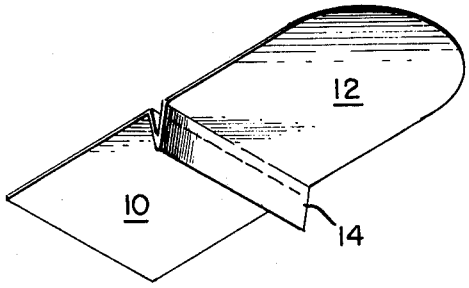
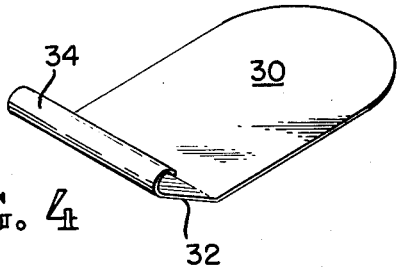
FIG. 4
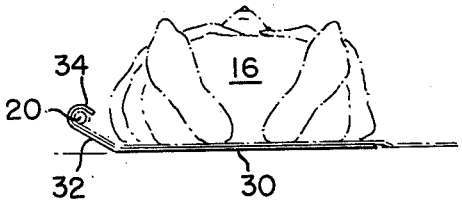
FIG. 5
FIG. 3
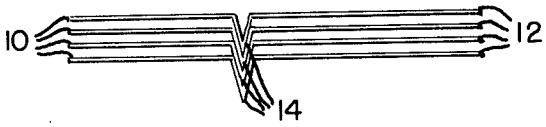

APPARATUS AND METHOD FOR TRANSFERRING A PATIENT FROM ONE BED TO ANOTHER

BACKGROUND OF THE INVENTION

1. Field of the Invention

This invention relates to medical aids for the invalid and, more particularly, to an apparatus and method allowing one person to transfer a patient between beds.

2. Description of the Prior Art

In hospitals it is frequently necessary to transfer a patient from one bed to another under circumstances where the patient is unable to assist in the transfer. A common example of this situation is the transfer of a patient from a wheeled stretcher to a hospital bed following surgery. Presently, the transfer is made by supporting the patient on a drawsheet. A drawsheet is a folded sheet extending from one side of the bed to the other and having a length substantially less than the height of the patient. The patient is placed on top of the drawsheet, and several hospital workers grasp both sides of the drawsheet and lift the patient from one bed to the other. Another conventional method of transferring a patient from one bed to another is for several hospital workers to place their arms underneath the patient and lift the patient from one bed to the other. Both of these aforementioned practices have two major disadvantages. First, the transfer requires the assistance of more than one person. The time required to assemble the number of people needed to perform the transfer results in needless delay and increases the cost of health care. Second, the transfer places localized stress on the patient's body, making a post-operative transfer extremely painful.

Another patient moving procedure commonly performed in hospitals is periodically turning the patient in order to prevent bed sores. The usual procedure for performing this task is for several nurses to grasp the patient and lift. Once again, this task requires more than one person, and it can be extremely painful for the patient.

SUMMARY OF THE INVENTION

It is an object of this invention to provide an apparatus and method allowing a single nurse to transfer a patient from one bed to another.

It is another object of this invention to provide an apparatus and method which transfer a patient from one bed to another without causing pain to the patient, even when the transfer immediately follows surgery.

It is still another object of the invention to provide a transfer apparatus which is easy to use, light in weight and relatively inexpensive.

These and other objects of the present invention are accomplished by a plurality of sled boards which support the patient during the transfer. In a first embodiment, the sled boards are placed beneath both the patient and the drawsheet, the drawsheet is rolled onto a bar, and the bar is secured to the ends of the boards. The bar is then pulled by a single nurse from the occupied bed to the empty bed to slide the sled boards onto the empty bed. The patient remains on top of the sled boards during the entire transfer, and the sled boards carry the patient from one bed to the other. In a second embodiment of the invention, a plurality of sled boards are placed beneath the patient, with the sled boards extending from one bed to the other. Each of the boards includes a transverse fin projecting from the bottom surface thereof. The fin is inserted between the beds to prevent longitudinal movement of the sled boards. A single nurse standing on the opposite side of the empty bed from the occupied bed grasps the drawsheet and pulls it and the patient across the sled boards from one bed to the other. The sled boards are then removed from beneath the patient.

BRIEF DESCRIPTION OF THE DRAWINGS

FIG. 1 is an isometric view showing the sled boards of the first embodiment in use transferring a patient from one bed to another.

FIG. 2 is an isometric view showing the sled board of the first embodiment.

FIG. 3 is an elevational view showing several sled boards of the first embodiment nested together.

FIG. 4 is an isometric view showing the sled board of the second embodiment.

FIG. 5 is an elevational view taken along the axis of the patient showing the sled board of the second embodiment in operation.

DETAILED DESCRIPTION OF THE INVENTION

With reference to FIGS. 1 and 2, the sled board of the first embodiment includes a first planar surface 10 separated from a second planar surface 12 by a transverse fin 14. The sled is preferably formed from a single sheet of bendable material which is transversely bent to form the fin 14. However, the boards may also be molded to the finished shape. As illustrated in FIG. 1, the rounded ends 12 of several sled boards are placed beneath the patient 16 and, in the case of the center sled board, also beneath the drawsheet 18. Although boards having different shapes may be used, the rounded end facilitates placement of the sled board, particularly when used with heavy patients. Although three sled boards are shown in operation here, the number used may vary, depending upon the characteristics of the patient. Very small adults and children and may require only two sled boards, while taller and heavier people may require four. Generally, one sled board will be placed underneath the shoulders, one underneath the buttocks and one beneath the feet. If the patient 16 is unable to raise his head, a sled board under the head may also be desired. After the sled boards have been placed beneath the patient 16, the drawsheet 18 is rolled onto a bar 20 having a length approximately equal to the height of the patient. A loop of flexible material 22 encircling the patient's legs also engages the bar 20. The nurse 24 standing on the opposite side of the empty bed 26 from the occupied bed 27 grasps the bar 20 and pulls it toward her. The drawsheet 18 then slides along the top surface of the planar portion 12, over the rib 14 and onto the planar section 10, resting on the previously empty bed 26. The bar 20, pulling on the loop 22, carries the legs of the patient along with the upper portion of the body. Although the use of a bar 20 is desired, the patient 16 may be transferred by simply grasping the drawsheet 18 and sliding it and the patient over the top surfaces of the sled boards. The rib 14 extending between the beds prevents longitudinal movement of the sled boards in response to the patient's sliding thereacross. After the patient 16 has been transferred to the previously empty bed 26, the drawsheet 18 is unrolled from the bar 20 and the sled boards are removed from beneath the patient 16.

As illustrated in FIG. 3, several sled boards of the first embodiment may be stacked on top of each other, with the fins 14 nested together. This configuration allows compact storage of the sled boards.

Referring now to FIGS. 4 and 5, the sled board of the second embodiment includes a planar surface 30 having rounded corners, an upwardly extending planar portion 32 and a curved lip 34. In operation, several of these sled boards are placed beneath the patient, and, as in the first embodiment, the drawsheet 18 is rolled onto the bar 20 and the bar is inserted into the curved lip 34, as best illustrated in FIG. 5. The nurse 24, standing as shown in FIG. 1, grasps the bar 20 and pulls it toward her, simultaneously siding the sled boards from the occupied bed 27 to the previously empty bed 26. The patient 16 remains on the surface 30 of the sled boards and the sled boards transfer the patient between beds. When the patient has been transferred to the bed 26, the bar 20 is disengaged from the curved portion 34, the drawsheet 18 is unrolled therefrom, and the sled boards are removed from beneath the patient 16. Although the use of a drawsheet is preferred, a drawsheet is not necessary since the patient can be placed directly on the surface 30. Since, in this embodiment, the patient does not slide on the sled board, a drawsheet is not required to reduce the sliding friction.

The dimensions of the sled board are not critical. The length of the portion 30 should be at least as wide as the patient's body, and it should be wide enough to provide sufficient support. The upwardly extending portion 32 should be bent at a sufficient angle to prevent the pole from contacting the beds during the transfer and to allow hand clearance beneath the pole 20. The planar, upwardly extending portion 32 easily allows transfer from one bed to a higher bed.

The sled board of the second embodiment can also be advantageously used to turn a patient. One or more boards are placed beneath the patient and the upwardly extending portions 32 are lifted to place the planar portion 30 in a substantially vertical position. The planar portion 30, in moving from a level position to a substantially vertical position, also rotates the patient ninety degrees. Pillows (not shown) may then be placed adjacent the patient to maintain the patient in his new position.

The sled board of either embodiment may be fabricated from stainless steel, fiber glass, MASONITE or plastic. It may be produced as a single sheet and bent to the required shape or it may be initially molded into the finished shape. It is relatively inexpensive to produce and allows a single nurse to easily transfer a patient from one bed to another.

The embodiments of the invention in which a particular property or privilege is claimed are defined as follows:

1. An apparatus for transferring a patient from one bed to another, comprising:

an elongated bar having a length greater than half the height of said patient; and a plurality of sled boards spaced apart along the length of said patient adjacent said bar, each of said boards including a planar support surface having a length sufficient to extend from one side of said patient to the other side of said patient with one end of said support surface terminating in a releasable bar securing portion curving upwardly and then toward said support surface, the curve of said securing portion being adapted to conform to the periphery of said bar such that when the support surfaces of said boards are placed beneath said patient and said securing portions are engaged by said bar, forces exerted on said bar away from said patient simultaneously slide said boards from one bed to another.

2. The apparatus of claim 1 wherein each of said sled boards is generally rectangular, having rounded corners at the end opposite said lip.

3. A sled board for transferring a patient from one bed to another, comprising:

a generally rectangular sheet having a planar top surface; and a relatively short, transverse fin projecting downwardly from the lower surface of said sheet, said fin being an integrally formed transverse channel having tapered sidewalls so that a plurality of said sled boards may be stacked with said fins nested together, said fin being adapted to fit between said beds while the lower surfaces of said sheet rest on said beds in order to prevent longitudinal movement of said sled board when said patient slides thereacross from one bed to another.

4. The apparatus of claim 3 wherein said fin is an integrally formed transverse channel having tapered sidewalls so that a plurality of said sled boards may be stacked with said fins nested together.

5. A method of transferring a patient from one bed to another, comprising:

placing a plurality of planar sled boards beneath said patient at spaced apart points along the patient's body; and simultaneously sliding said boards and said patient as a unit from the occupied bed to the empty bed with said boards simultaneously maintaining contact with at least one of said beds and removing said boards from beneath said patient.

6. The method of claim 5 wherein said boards are slid from one bed to another by securing a bar to each of said boards and applying a force to said bar in the direction of the empty bed.

7. A method of transferring a patient from one bed to another, comprising:

placing a drawsheet beneath said patient;

inserting a sled board under said drawsheet;

rolling said drawsheet on a bar from the side of said drawsheet adjacent the empty bed toward the opposite side of said drawsheet until said bar approximately reaches said sled board;

securing said bar to said sled board;

sliding said sled board from the occupied bed to the empty bed by applying a force to said bar in the direction of said empty bed;

disengaging said bar from said board;

unrolling said drawsheet from said elongated member; and removing said sled board from beneath said drawsheet and patient.

8. The method of claim 7 wherein a plurality of said boards are placed under said patient at spaced apart points along the patient's body and said bar is secured to each of said sled boards.

9. A method of transferring a patient from one bed to another, comprising:

placing said patient on top of a drawsheet;

placing a sled board beneath said drawsheet;

grasping the side of said drawsheet adjacent the empty bed;

pulling the drawsheet toward the empty bed to slide the patient and drawsheet over said sled board from the occupied bed to the empty bed; and removing said sled board from beneath said drawsheet.

10. The method of claim 9 wherein said sled board contains a transverse fin projecting from one face, and said fin is inserted between the beds while said sled board is placed beneath said drawsheet so that said sled board remains stationary while said patient slides from one bed to the other.

* * * * *